US008205579B2

(12) United States Patent
Pellei

(10) Patent No.: US 8,205,579 B2
(45) Date of Patent: Jun. 26, 2012

(54) STAY-ALONG LEAD FOR GUIDING INDIVIDUALS

(76) Inventor: Robyn Pellei, Charlotte, NC (US)

( * ) Notice: Subject to any disclaimer, the term of this patent is extended or adjusted under 35 U.S.C. 154(b) by 16 days.

(21) Appl. No.: 12/550,613

(22) Filed: Aug. 31, 2009

(65) Prior Publication Data

US 2010/0050956 A1 Mar. 4, 2010

Related U.S. Application Data

(60) Provisional application No. 61/190,586, filed on Aug. 29, 2008.

(51) Int. Cl.
*A01K 27/00* (2006.01)

(52) U.S. Cl. ..... 119/770; 119/857

(58) Field of Classification Search ..... 119/770, 119/857, 795, 791, 858, 798; D30/153
See application file for complete search history.

(56) References Cited

U.S. PATENT DOCUMENTS

| | | | | | |
|---|---|---|---|---|---|
| 3,563,208 | A | | 2/1971 | Nero | |
| 4,563,981 | A | | 1/1986 | Kramer | |
| 4,638,764 | A | * | 1/1987 | Anderson | 119/770 |
| 4,666,017 | A | | 5/1987 | Zimmerman | |
| 4,667,624 | A | | 5/1987 | Smith | |
| 4,688,564 | A | * | 8/1987 | Kelly | 128/878 |
| 4,745,883 | A | | 5/1988 | Baggetta | |
| 4,751,896 | A | * | 6/1988 | Miley | 119/770 |
| 4,763,609 | A | * | 8/1988 | Kulik | 119/797 |
| 4,765,279 | A | | 8/1988 | Klickstein | |
| 4,936,699 | A | * | 6/1990 | Yoshida | 401/48 |
| D320,049 | S | | 9/1991 | Takahashi et al. | |
| 5,069,168 | A | | 12/1991 | Roberson et al. | |
| D328,658 | S | | 8/1992 | Savage | |
| 5,247,906 | A | * | 9/1993 | Stevenson | 119/795 |
| 5,325,818 | A | | 7/1994 | Leach | |
| 5,423,292 | A | | 6/1995 | Hall | |
| D361,263 | S | | 8/1995 | Carmo et al. | |
| 5,447,121 | A | | 9/1995 | Spence | |
| 5,638,772 | A | | 6/1997 | Kaufmann et al. | |
| D383,256 | S | | 9/1997 | Hampton | |
| 5,699,555 | A | | 12/1997 | Schunter | |
| 5,718,189 | A | * | 2/1998 | Blake | 119/770 |
| 5,848,576 | A | | 12/1998 | Colaianni | |
| 5,878,698 | A | * | 3/1999 | Lyell | 119/863 |
| 6,289,903 | B1 | * | 9/2001 | Haufler | 132/275 |
| D454,416 | S | * | 3/2002 | Kaplan | D30/153 |
| D454,670 | S | * | 3/2002 | Weller | D30/153 |
| 6,371,055 | B1 | * | 4/2002 | Lawrence | 119/719 |
| D458,414 | S | | 6/2002 | Major | |
| 6,422,176 | B1 | * | 7/2002 | Tonuzi | 119/770 |

(Continued)

*Primary Examiner* — Yvonne Abbott
(74) *Attorney, Agent, or Firm* — Summa, Additon & Ashe, P.A.

(57) ABSTRACT

The invention provides a new tether or leash product in the form of a guide assembly that provides an alternative to wrist cuffs and harnesses that physically bind a dependent individual. The guide assembly, or tether system, allows a dependent individual to engage a security grip or handle in the shape of a character or other appealing design. The security grip is removably attached to a tether, lead, line, or other extension device that ultimately connects to another individual, such as a parent or a caregiver. The dependent individual is trained to engage the security grip by removing the security grip from the lead portion of the guide assembly and enjoying the security grip as a separate toy. By developing an affinity for the security grip, the dependent individual desirably engages the security grip when in use with the guide assembly.

15 Claims, 4 Drawing Sheets

U.S. PATENT DOCUMENTS

| | | | | |
|---|---|---|---|---|
| 6,539,897 | B1 * | 4/2003 | Dossenback | 119/795 |
| 6,553,944 | B1 * | 4/2003 | Allen et al. | 119/769 |
| D508,156 | S * | 8/2005 | LaFauci et al. | D2/610 |
| D535,058 | S | 1/2007 | Boutin | |
| D540,988 | S | 4/2007 | Stephen et al. | |
| D554,955 | S | 11/2007 | Raia | |
| D561,945 | S | 2/2008 | Boutin | |
| D573,662 | S | 7/2008 | Behn et al. | |
| 2004/0194733 | A1 | 10/2004 | Bremm | |
| 2007/0125315 | A1 * | 6/2007 | Ginakes | 119/770 |
| 2007/0175939 | A1 * | 8/2007 | Gold et al. | 224/576 |

* cited by examiner

STAY-ALONG LEAD FOR GUIDING INDIVIDUALS

CROSS REFERENCE TO PRIOR APPLICATIONS

This application claims priority to and incorporates by reference herein U.S. Provisional Patent Application Ser. No. 61/190,586 filed on Aug. 29, 2008 and entitled "Walking Rope with Voluntary Handle in Shape of Character."

FIELD OF THE INVENTION

The invention relates to the field of tethers, ropes, and lines for guiding individuals, particularly children, and ensuring that a first individual follows another individual, such as a caregiver. The rope or tether of this invention allows one individual to hold one end of the device while the other end is controlled by the responsible caregiver. This allows the caregiver to lead the dependent individual to a safe destination. The invention accomplishes the goal of safely guiding persons who need to stay in proximity with another individual, such as a child needing to stay with a parent in a busy, heavily populated or otherwise congested area.

BACKGROUND OF THE INVENTION

Individuals in today's society operate in mobile environments, whether walking with a family through an airport or walking with classmates on a school outing. Young children, and even certain older individuals, sometimes need extra care, but they are encouraged to participate in all aspects of life in a safe and fulfilling manner. These individuals, referred to herein as "dependent individuals" (e.g., toddlers, children who need supervision, people with disabilities, and senior citizens), are often accompanied by parents or caregivers who maintain control of the dependent individual's movements. The term "dependent individuals" is descriptive of any individual who desires to use the guide system described herein and is not limiting of the invention. Similarly, terms such as parent, caregiver, supervisory individual, and the like are used in their broadest sense in this case and are not limiting of the scope of the claims.

There was a time when holding hands with a caregiver was the only way to limit the range in which a dependent individual moved. As time has progressed and life has become more complicated, caregivers need to keep up with dependent individuals in a hands free manner. For example, while shopping, a parent needs to control the free range of a child and simultaneously pick up items for purchase or carry shopping bags. In an airport, a caregiver needs to maintain proximity with a dependent individual while also carrying luggage from one terminal to the next. Hands free control of a dependent individual has, therefore, been a worthy goal for quite some time but has yet to be realized in a convenient way.

As noted above, many caregivers wish to constrict the movements of their young children and other individuals during certain activities, such as airport travel, walking along busy streets, shopping, or attending large gatherings such as concerts, festivals, parades, and the like. A common fear among parents and caregivers is that of losing the dependent individual in a crowd or unintentionally allowing the dependent individual to move into a dangerous situation. Efforts to address these fears are set forth in prior patents and publications that are publicly available. The prior art shows leash and harness systems used to constrain the motion of these dependent individuals, but leash and harness systems have a number of disadvantages. Notably, leash and harness systems are often considered to be socially unacceptable because people consider them to be appropriate only for animals and not for people. Leash and harness systems for dependent individuals also require the caregiver or parent to hold on to leads or lines. Requiring a parent or caregiver to use their hands to control the dependent individual defeats the goal of allowing hands-free movement with the assurance that the dependent individual will not stray outside a known boundary.

The prior art shows certain leash and harness systems that individuals use to maintain control over the range in which a dependent individual moves about a caregiver. For example, U.S. Pat. No. 4,688,564 (Kelly 1987) discloses a leash system that uses cuffs attached by a flexible tether to both a child and an adult. This kind of tethering system, however, gives an appearance of a handcuff arrangement that has a punitive image that is generally negative to the casual observer. Children and dependent adults may also dislike such blatant forms of constriction and are apt to refuse wearing a binding cuff about their person.

The prior art is replete with cuff assemblies that wrap around a wrist or other body part of both the dependent individual and the caregiver. These cuffs are most often adjustable in size to fit both parties and are connected by a leash or cord that extends between the cuffs. See U.S. Pat. No. 4,751,896 (Miley 1988); U.S. Pat. No. 4,765,279 (Klickstein 1988); U.S. Design Pat. No. D458,414 (Major 2002). In a different embodiment of the same idea, the cuffs are connected by an elastic line that stretches to a certain extent and increases the range of motion of the dependent individual. See U.S. Pat. No. 4,745,883 (Baggetta 1988).

As noted above, one resolution to the problem of controlling the mobility of a dependent individual lies in the use of a traditional harness. The harness typically fits about the torso of the dependent individual and often includes shoulder straps or belts that cross over in the front or the back. The dependent individual wears the harness on his torso, and an extendable lead connects to another individual (e.g., a parent or a caregiver). The harness system is extremely noticeable to those around the dependent individual. Accordingly, as children get older, they are less inclined to agree to wearing a harness because the children feel that it is babyish or embarrassing. Older individuals also dislike harnesses because they are hard to fit properly (requiring multiple belt adjustments), or the individuals feel conspicuous in such a piece of equipment. A standard harness is set forth in U.S. Pat. No. 5,325,818 (Leach 1994). Systems that use such a harness with extendible leashes and wrist cuffs for the caregiver or parent are shown in U.S. Pat. No. 4,666,017 (Zimmerman 1987) and U.S. Pat. No. 5,069,168 (Roberson 1991). Instead of the parent or caregiver connecting to the harness assembly by a wrist cuff, certain other designs utilize waist belts for connecting the harness to the care giver. See U.S. Pat. No. 4,667,624 (Smith 1987) and U.S. Design Pat. No. D383,256 (Hampton 1997).

In a different take on the harness and leash concept, the prior art shows numerous safety tethers that use belts that fit around the waist of the dependent individual and the parent or caregiver. See U.S. Pat. No. 5,848,576 (Colaianni 1998). The problems with this embodiment include the discomfort of another belt and the possibility of injury—if one person stumbles or falls, both are likely to lose their footing with a force pulling at their respective waistlines. U.S. Pat. No. 5,699,555 (Schunter 1997) includes a wrist band and waist band combination that focuses on attaching one end of the tether to a dependent individual's waist and the other end of the tether to a caregiver's wrist band. Still, the overall problem lies in comfort, safety, and allowing a caregiver hands free movement.

The problem of monitoring and maintaining a safe range of motion for dependent individuals is also present in classroom situations. Preschools and younger grades for elementary students often desire to take the children on class trips or at least for a walk outside.

One problem to note in all of these prior art tether or rope systems is that none of them is appealing to the dependent individual being led. While a dependent individual may acknowledge a desire to stay with the caregiver or parent, doing so upon their own volition is key to smooth travel. One goal of this invention, therefore, is to make the tethering or guiding system desirable to the individual being guided. The prior art is generally void of guiding systems that actually encourage a dependent individual to use and engage a tethering arrangement. The Tonuzi '176 patent and the Boutin '058 patent, both noted above, incorporate animal shapes into parts of their group tether systems, but they give little indication of the purpose behind such shapes. U.S. Pat. No. 5,638,772 (Kaufmann, 1997), using a waist belt at both ends of a retractable tether, adds a decorative toy to both ends of the tether to hide the attachment points and hardware about each individual's waist. Kaufmann is silent, however, on the issue of whether the decorative toy affects the dependent individual's attitude toward using the tether.

The prior art shows a need, therefore, for a guide system or tether, that is appealing to the dependent individual and operates in a way that allows the caregiver or parent to control movement in a convenient, acceptable, and hands-free way.

BRIEF SUMMARY OF THE INVENTION

The invention provides a new guide assembly for ensuring that a dependent individual stays along with another individual, such as a parent or caregiver, in crowded or congested areas. The guide assembly may include a detachable security grip at one end of a lead portion extending between the dependent individual and the supervisory individual. The security grip is in the shape of a character, design, or emblem that is attractive to the dependent individual and serves as a kind of lure to encourage use of the guide assembly as a "stay-along" lead. The lead portion connects to the other, supervisory individual at the end opposite the security grip. The supervisory individual may attach the proximate end of the lead portion to his person, his clothing, or an object in his control.

The invention is further characterized as a method of training a dependent individual to stay along with a parent or caregiver. The security grip in the form of a character is detachable from the overall guide assembly or safety tether. Once detached, the security grip can be used as an ordinary toy or object of affection, similar to a doll or a teddy bear. The dependent individual may develop an affinity for the security grip apart from its use as a part of the guide assembly. In this way, the dependent individual desires to stay with the security grip and will grab hold to the security grip as necessary to stay with the caregiver attached to the guide assembly at the other end.

DETAILED DESCRIPTION

The invention is a guide line assembly (10) that allows a caregiver or a parent to maintain close proximity with a dependent individual and motivates the dependent individual to engage the guide line assembly (10). For purposes herein, the term "individual" is all encompassing of persons of every age and is not limiting of the invention. A "dependent individual" is any person of any age that benefits from a limited range of mobility in particular situations. The terms "caregiver," "parent," and similar terms refer to all individuals that would like to ensure the safety of a dependent individual by guiding them via a tethering arrangement. Such terms are descriptive and do not affect the scope of the claims that follow this detailed description.

Figure 1:
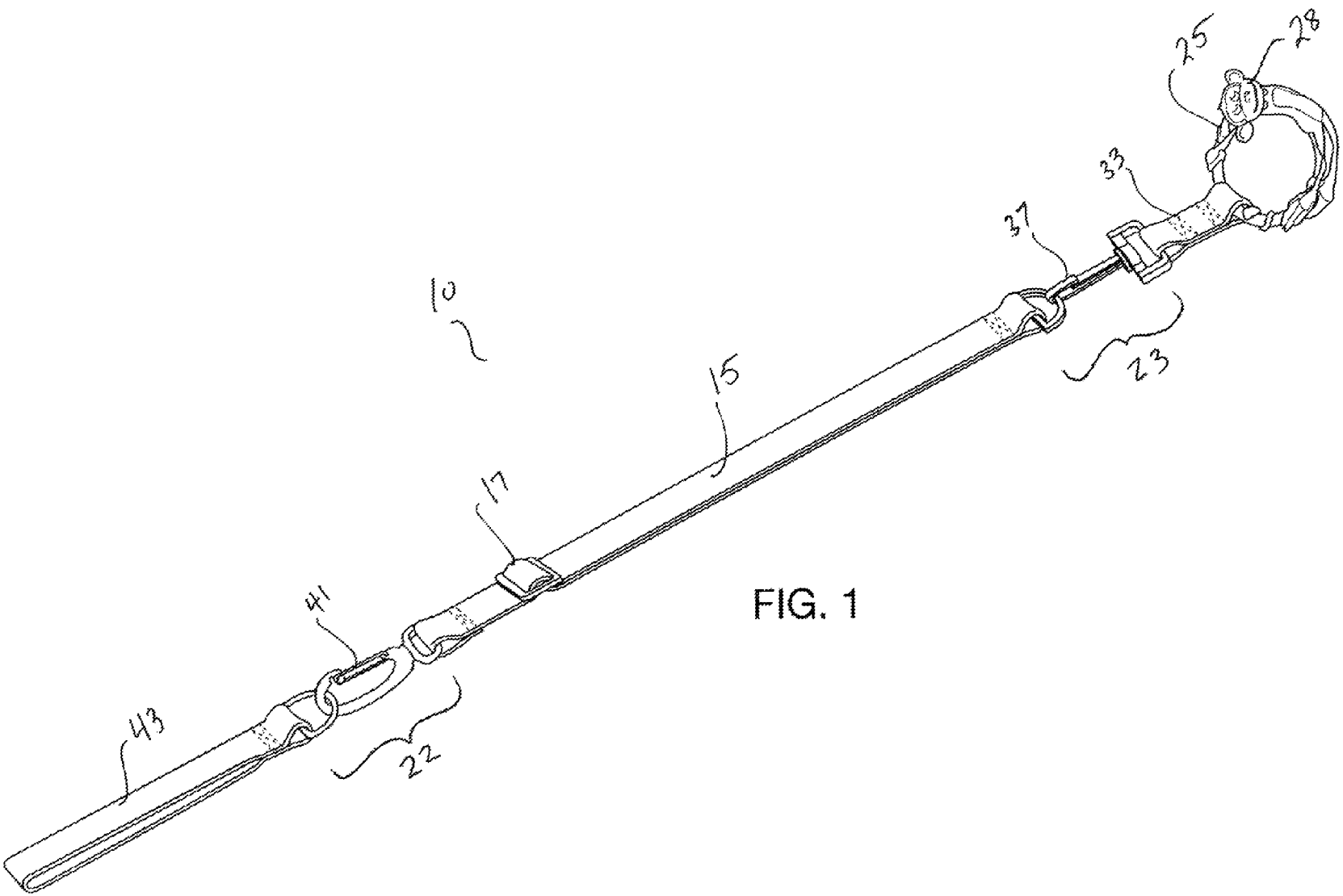
FIG. 1 is a perspective view of the overall guide assembly according to this invention.
Figure 2:
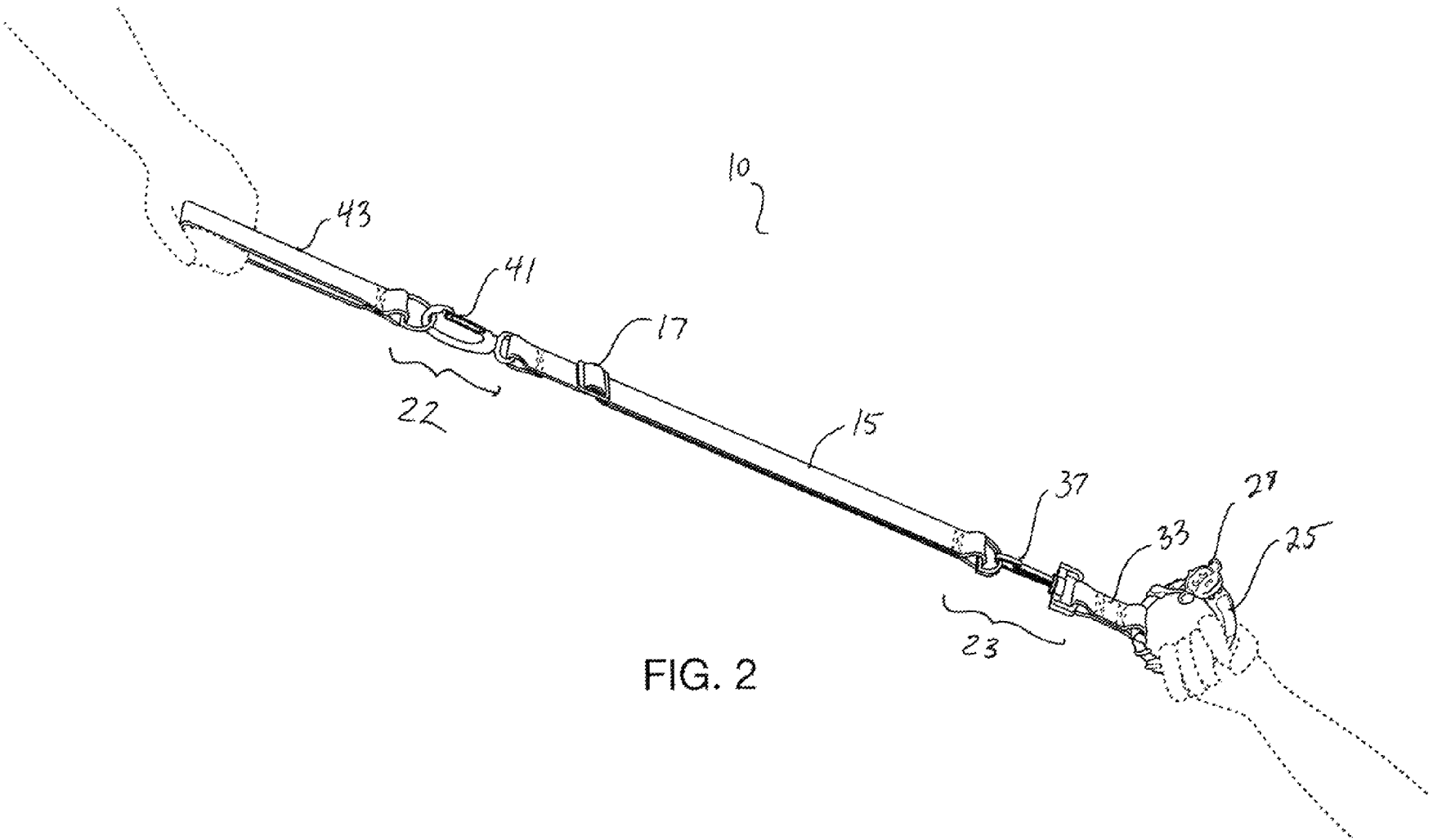
FIG. 2 is a perspective view of the guide assembly of FIG. 1 in use with a caregiver engaging one end and a dependent individual engaging an opposite end.
Figure 3:
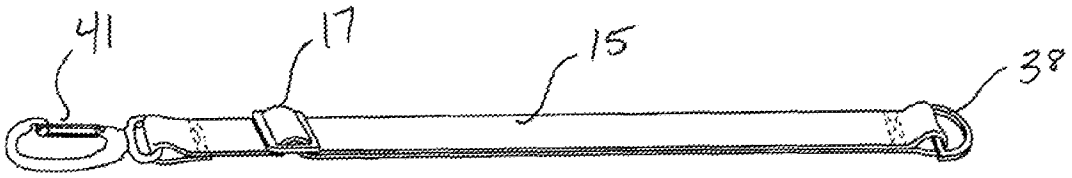
FIG. 3 is a perspective view of the lead portion of the guide assembly of this invention buckled to its shortest length.
Figure 4:
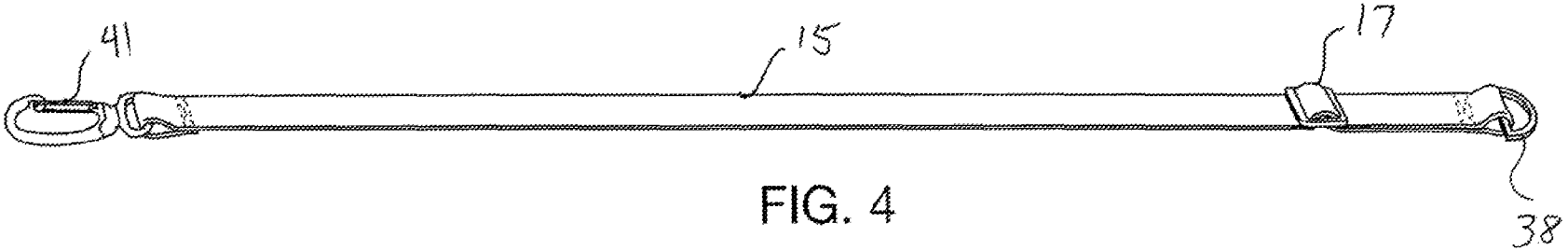
FIG. 4 is a perspective view of the lead portion of the guide assembly of this invention buckled to its fullest length.
Figure 5:
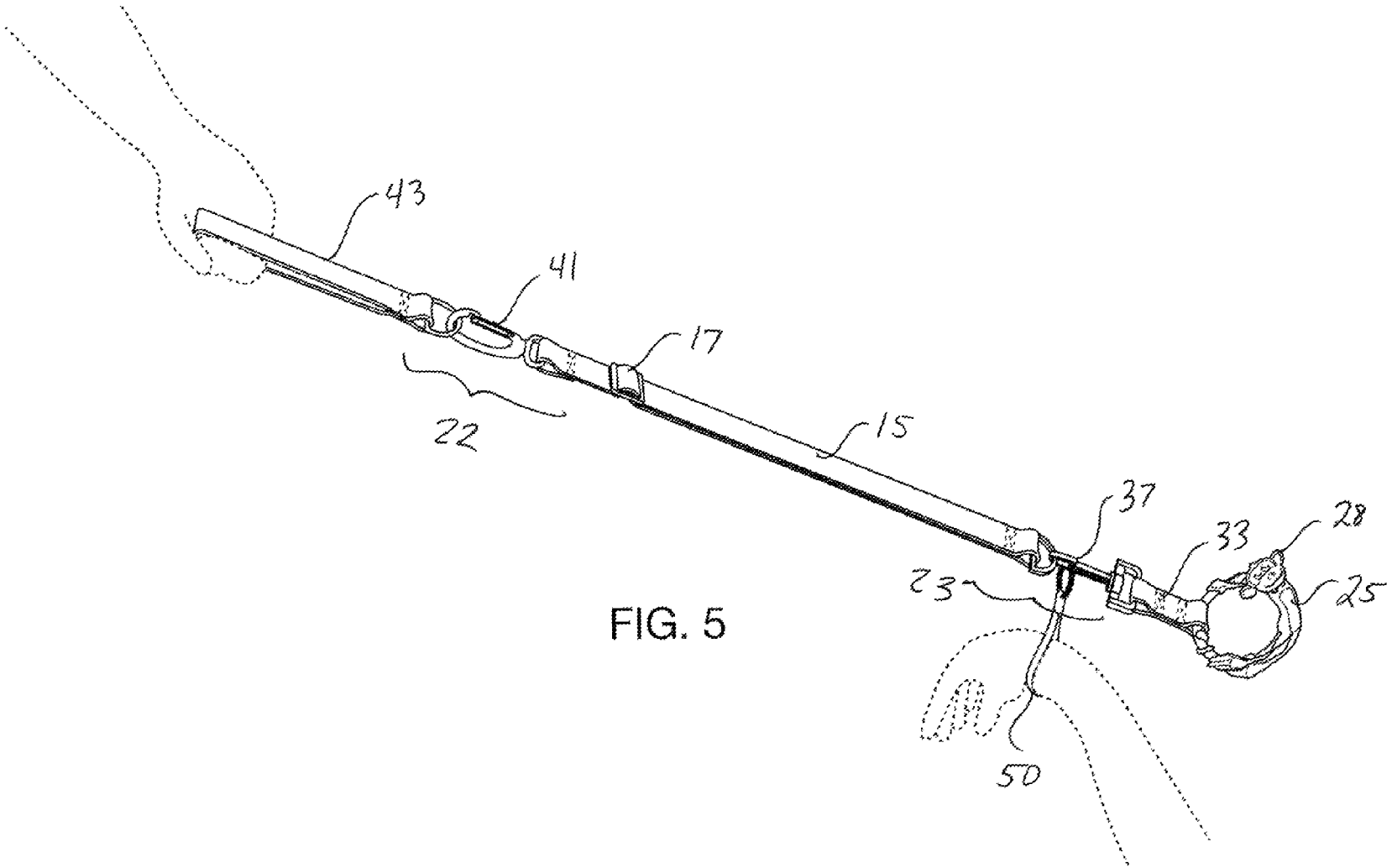
FIG. 5 is a perspective view of the guide assembly of FIG. 1 in use with a caregiver engaging one end and an adjustable cuff engaging a dependent individual at an opposite end.

One embodiment of the invention is set forth in FIG. 1. The guide assembly (10) is characterized, in part, by a lead portion (15) that is generally of an elongated shape. The lead portion (15) may be made of any kind of rope, tether, cord, coil, reel, wire, and the like, so long as it is adapted to extend between two individuals. The lead portion (15) may be on a reel that winds and releases the length of the lead. Alternatively, the lead portion (15) may include a buckle or a loop (17) that allows one to change the length of the lead portion (15). The lead portion (15) may include attachment mechanisms (22, 23) on either end; in one embodiment, the attachment mechanism (23) at one end is a D-Clip or any kind snap or pin or hook that allows attachment to a separable part of the overall guide assembly (10). The attachment mechanisms (22, 23) are adapted for movement, such as swiveling about a certain point, to make the guide assembly (10) more comfortable to use.

In one respect, the guide assembly (10) may include a security grip (25) for the dependent individual to grasp one end of the lead portion (15). The invention includes a new design for a security grip (25) that reduces the need for binding or directly attaching a cuff or harness to the dependent individual. Instead, the security grip (25) is enticing to the dependent individual and keeps the dependent individual's interest in staying with the guide assembly (10). To maintain the dependent individual's interest, the security grip (25) is of a special design that is particularly appealing to the dependent individual. By way of example, and without limiting the invention herein, the security grip may be in the form of a character (28) that is interesting to the dependent individual. The term "character" as used herein includes all forms of shapes and designs, whether the designs form an animal, a human, a cartoon, or any image of an appealing nature to the dependent individual. In addition to traditional characters, the security grip (25) may be in the shape of a desirable object, such as a toy, or an object of nature, such as a star, moon, sunshine, etc. The term "toy" includes any shape that a dependent individual would like to hold or play with and is not limiting of the invention. The exact form, color, shape, or design of the character (28) is not critical, so long as it causes the dependent individual to stay with and to hold on to the security grip (25). In one embodiment, the character (28) may be formed within the detachable security grip (25) by forming the security grip (25) from a mold that includes the character or design therein (i.e., injection molding). In this way, the character or design (28) is integral with the security grip (25)

itself. Other methods of ensuring that the security grip bears the appropriate design include engraving, embossing, etching, painting, and applying stickers. The design of the security grip may include letters, numbers, or anything that the dependent individual can find interesting.

To increase the desirability of the security grip (25) to the dependent individual, the invention allows for the security grip (25) to be removable from the guide assembly (10). To this end, in one embodiment, the guide assembly (10) may include a connector (33) and corresponding clip (37) as parts of a clip assembly (23) to releasably hold the security grip (25) to the lead portion (15). The security grip (25), therefore, may be detached from the lead portion (15) and used without the lead portion.

By detaching the separable security grip (25), the invention allows a dependent individual to use and play with the security grip (25) outside the confines of traditional use of the guide assembly (10). In this way, the dependent individual, such as a child, may gain familiarity and even a close attachment to the security grip (25). The security grip (25), then, is similar to a child's favorite doll or teddy bear to which the child clings for comfort. The parent or caregiver can encourage this attachment by making the security grip (25) available in other situations, such as by detaching the security grip (25) from the lead portion (15) of the guide assembly (10) and reattaching the security grip (25) to a accessory items associated with the dependent individual (i.e., a stroller, a car seat, a baby swing, a wheel chair, high chair, mobile, crib, or any other item that gives the dependent individual an opportunity to engage and interact with the security grip). In this way, the dependent individual recognizes the security grip (25) when it is on the guide assembly (10), is attracted to the security grip (25) thereon, and is likely to hold on to the security grip (25) when in use with the guide assembly (10).

By encouraging the dependent individual to consistently become familiar with the security grip (25), the guide assembly (10) works without a direct or binding attachment to the dependent individual. Instead, the guide assembly (10) of this invention works through the dependent individual's own choice to hold the security grip (25). At the end of the guide assembly (10) opposite the security grip (25), the lead portion (15) is adapted by a supervisory connector (41), such as a hook, loop, clip, etc., to be removably attached to the caregiver or the parent. The term "supervisory connector" is intended to encompass any device that connects the lead portion to the individual in charge of the dependent individual. The term "supervisory connector" is merely a term used to distinguish the connector at one end of the lead portion from the connectors and attachment mechanisms used to connect the security grip to the lead portion. The term "supervisory connector" is not limiting of the invention in any way.

The lead portion (15) may be fitted with a clip or hook (41) that allows the caregiver to attach the lead portion (15) to the caregiver's belt, clothing, or other personal item. The lead portion (15) may also be fitted with a handle (43) that is attached at the end of the lead portion (15) opposite the security grip (25). The handle (43) may be removable so that the caregiver or parent can use the guide assembly (10) by hand or by attaching to the clip.

Overall, the guide assembly (10) (also referred to as a stay along lead or safety tether system) can be described as including detachable components along the length of the assembly (10). The detachable components are connected to each end of a lead portion (also referred to as a guiding line) (15) by respective attachment mechanisms (22, 23) on either end of the lead portion (15). The attachment mechanisms (22, 23) may include clips, hooks, loops, grips, buckles, and the like for attaching sections of a tether to another part of the system. In this regard, the guide systems of this invention incorporate both a security grip attachment mechanism (23) (proximate the dependent individual) and a supervisory attachment mechanism (22) (for connecting the parent or caregiver or a moveably object under the caregiver's control to the lead).

The invention is also described as a method of training a dependent individual to maintain close proximity to a caregiver when situations require such care. As noted above, the invention is useful, in part, by its modular assembly that allows pieces to be removed. In this way, the care giver can train the dependent individual to look for and feel comfortable with the security grip portion of the guide assembly. To accommodate the training period, the security grip may also include an adjustable cuff (50) at the end of the lead portion (15) adjacent the security grip (25). The adjustable cuff (50) wraps around the dependent individual's wrist for those occasions when maximum security is necessary and during the period when the caregiver is giving the dependent individual time to learn about the security grip and the overall guide system. The adjustable cuff (50) is most likely only a temporary measure to aid in training the dependent individual for guide assembly use. Accordingly, the adjustable cuff (50) may be removable from the guide assembly (10).

For purposes herein, the guide assembly may also be referred to as a "stay-along" lead, as it encourages a dependent individual to "stay along" with the caregiver or more responsible supervisory individual. Whether referred to as a guide line, a guide system, a stay along lead, or a safety tether, the invention is an improvement over the prior art cuffs and harnesses that have become prevalent in this area but are not at all desirable to dependent individuals. Notwithstanding the various names and the figures showing use with one dependent individual, the overall guide system can be used to accommodate multiple children and have the same effect for each. In other words, the guide system shown in the figures may be adjusted such that a single lead portion connects to multiple security grips or additional tethers. Such modifications do not change the overall method of using the guide system. The system is also useful in its ability to (i) allow the dependent individual to engage the security grip and (ii) to connect the other end of a tether to a moveable object controlled by the supervisory individual (e.g., a stroller, cart, toy vehicle, and the like.) In other words, descriptions that note connecting the guide assembly to a dependent individual and another supervisory individual include connections to objects controlled by the supervisory individual.

In the specification and drawings, typical embodiments of the invention have been disclosed and, although specific terms have been employed, they have been used in a generic and descriptive sense only and not for purposes of limitation. Different kinds of leads, tethers, and guides may be substituted for the parts disclosed herein and still fall within the ambit of the invention. The invention is further set forth in the claims below.

The invention claimed is:

1. A stay-along lead for ensuring that an individual engaging one end of the lead stays with a different individual engaging the opposite end of the lead, the lead comprising:

an attachment mechanism at one end of the lead for connecting the lead to the individual;

a security grip at the opposite end of the lead, wherein said security grip comprises a surface that defines a likeness of a character formed within said security grip by a method selected from the group consisting of injection molding, engraving, embossing, etching, painting, and applying stickers, and wherein said security grip is detachable from the lead.

2. A stay-along lead according to claim 1, the stay along lead comprising detachable components along the length of the stay-along lead.

3. A stay-along lead according to claim 1, wherein said character is an animal.

4. A stay-along lead according to claim 1, wherein said security grip is a ring having said character molded into said ring.

5. A stay-along lead according to claim 4, wherein said character is formed within the shape of said detachable security grip.

6. A stay-along lead according to claim 1, wherein said attachment mechanism comprises a clip and a handle.

7. A stay-along lead for ensuring that an individual engaging one end of the lead stays with a different individual engaging the opposite end of the lead, the lead comprising:

a detachable security grip at the one end of the lead, said security grip bearing the likeness of a character;

an attachment mechanism at the other end of the lead for connecting the lead to the different individual;

wherein said detachable security grip is a ring having said character molded into said ring.

8. A stay-along lead according to claim 7, the stay along lead comprising detachable components along the length of the stay-along lead.

9. A stay-along lead according to claim 7, wherein said character is an animal.

10. A stay-along lead according to claim 7, wherein said character is formed within the shape of said detachable security grip.

11. A stay-along lead according to claim 7, wherein said attachment mechanism comprises a clip and a handle.

12. A stay-along lead for ensuring that an individual engaging one end of the lead stays with a different individual engaging the opposite end of the lead, the lead comprising:

a detachable ring at the one end of the lead, said ring bearing the likeness of a character applied directly to said ring;

an attachment mechanism at the opposite end of the lead for connecting the lead to the different individual.

13. A stay-along lead according to claim 12, wherein said likeness of said character is applied by painting the likeness of the character.

14. A stay-along lead for ensuring that an individual engaging one end of the lead stays with a different individual engaging the opposite end of the lead, the lead comprising:

an attachment mechanism at one end of the lead for connecting the lead to the individual;

a security grip at the other end of the lead, said security grip being detachable from the lead and bearing the likeness of a character, wherein said likeness of a character is formed within said detachable security grip by a method selected from the group consisting of injection molding, engraving, embossing, etching, painting, and applying stickers.

15. A stay-along lead according to claim 14, wherein said security grip is a ring.

* * * * *